US009212794B2

(12) United States Patent
Unger et al.

(10) Patent No.: US 9,212,794 B2
(45) Date of Patent: Dec. 15, 2015

(54) FLASHLIGHT INCLUDING HAND CRANK

(71) Applicant: Fiskars Brands, Inc., Madison, WI (US)

(72) Inventors: Brian Unger, Hillsboro, OR (US); Mark Neubauer, Milwaukie, OR (US)

(73) Assignee: Fiskars Brands, Inc., Madison, WI (US)

( * ) Notice: Subject to any disclaimer, the term of this patent is extended or adjusted under 35 U.S.C. 154(b) by 76 days.

(21) Appl. No.: 13/719,102

(22) Filed: Dec. 18, 2012

(65) Prior Publication Data

US 2014/0168958 A1 Jun. 19, 2014

(51) Int. Cl.

| | |
|---|---|
| ***F21L 4/00*** | (2006.01) |
| ***F21L 13/06*** | (2006.01) |
| *F21Y 101/02* | (2006.01) |

(52) U.S. Cl.

CPC ..... *F21L 13/06* (2013.01); *F21Y 2101/02* (2013.01)

(58) Field of Classification Search

CPC ..... F21L 13/06; F21L 13/08; F21L 4/08; H02J 7/32

USPC ..... 310/21

See application file for complete search history.

(56) References Cited

U.S. PATENT DOCUMENTS

| | | | |
|---|---|---|---|
| 4,315,301 | A | 2/1982 | Jimena |
| 4,360,860 | A | 11/1982 | Johnson et al. |
| 4,577,144 | A | 3/1986 | Hodgman et al. |
| 4,577,145 | A | 3/1986 | Mullersman |
| 4,645,996 | A | 2/1987 | Toops |
| 4,701,835 | A | 10/1987 | Campagnuolo et al. |
| 5,600,224 | A | 2/1997 | Mody et al. |
| 5,606,238 | A | 2/1997 | Spellman et al. |
| 5,652,496 | A | 7/1997 | Pilarzyk et al. |
| 5,722,307 | A | 3/1998 | Chen |
| 5,872,831 | A | 2/1999 | Zoiss et al. |
| 6,215,275 | B1 | 4/2001 | Bean |
| 6,322,233 | B1 | 11/2001 | Brandt |
| 6,479,962 | B2 | 11/2002 | Ziemkowski et al. |
| 6,505,952 | B1 | 1/2003 | Kish et al. |
| 6,588,918 | B1 | 7/2003 | Millar |
| 6,914,340 | B2 | 7/2005 | Becker et al. |

(Continued)

FOREIGN PATENT DOCUMENTS

| | | |
|---|---|---|
| TW | M280456 | 11/2005 |

OTHER PUBLICATIONS

Future Gear Extravaganza! 2012 Outdoor Retailer Preview, Jul. 26, 2012, http://gearjunkie.com, 16 pages.

(Continued)

*Primary Examiner* — Andrew Coughlin
(74) *Attorney, Agent, or Firm* — Foley & Lardner LLP

(57) ABSTRACT

A flashlight includes a housing that extends from a first end to a second end, a light source provided at the first end of the housing, a rechargeable power supply electrically coupled to the light source, a generator electrically coupled to the rechargeable power supply, and a hand crank coupled to the generator, the hand crank including a base and an arm, the hand crank movable between a storage position and a cranking position. The base is rotatably coupled to the second end of the housing. The arm is translatable relative to the housing between a retracted position and an extended position such that when the arm is in the extended position, the arm is pivotable relative to the base between a translation position in which the arm is substantially parallel to the housing axis and a fixed position in which the arm is substantially perpendicular to the housing axis.

20 Claims, 10 Drawing Sheets

(56) References Cited

U.S. PATENT DOCUMENTS

| | | | | |
|---|---|---|---|---|
| 7,222,984 | B2 | 5/2007 | Lee | |
| 2004/0156193 | A1 | 8/2004 | Chen | |
| 2008/0220827 | A1* | 9/2008 | Lin | 455/573 |
| 2008/0285262 | A1 | 11/2008 | Canino et al. | |
| 2009/0231839 | A1* | 9/2009 | Ford | 362/192 |

OTHER PUBLICATIONS

Office Action on AU Application 2013205278; mail date May 2, 2014; 4 pages.

* cited by examiner

FLASHLIGHT INCLUDING HAND CRANK

BACKGROUND

The present invention relates generally to the field of flashlights. In particular, the present invention relates to flashlights in which a generator rotates in response to a manual input to power the flashlight.

SUMMARY

One embodiment of the invention relates to a flashlight including a housing that extends along a longitudinal housing axis from a first end to a second end, a light source provided at the first end of the housing, a rechargeable power supply electrically coupled to the light source to power the light source, a generator electrically coupled to the rechargeable power supply to charge the rechargeable power supply, and a hand crank coupled to the generator to turn the generator, the hand crank including a base, a handle, and an arm having a first end coupled to the base and a second end coupled to the handle, the hand crank movable between a storage position and a cranking position. The base is rotatably coupled to the second end of the housing for rotation about the housing axis. The arm is translatable relative to the housing between a retracted position and an extended position such that when the arm is in the extended position, the arm is pivotable relative to the base between a translation position in which the arm is substantially parallel to the housing axis and a fixed position in which the arm is substantially perpendicular to the housing axis so that when the hand crank is in the storage position, the arm is in the refracted and translation positions and when the hand crank is in the cranking position, the arm is in the extended and fixed positions. The handle is pivotable relative to the arm such that when the arm is in the fixed position, the handle is rotatable about a handle axis substantially parallel to the housing axis.

Another embodiment of the invention relates to a method of operating a flashlight including the steps of providing a flashlight including a housing, a light source provided at an end of the housing, a rechargeable power supply electrically coupled to the light source to power the light source, a generator electrically coupled to the rechargeable power supply to charge the rechargeable power supply, and a rotatable hand crank coupled to the generator to turn the generator, translating an arm of the hand crank out of the housing in a direction substantially parallel to a longitudinal axis of the housing to an extended position, pivoting the arm relative to a base of the hand crank to a fixed position in which the arm is substantially perpendicular to the longitudinal axis, and rotating the hand crank about the longitudinal axis to turn the generator, thereby charging the rechargeable power supply and powering the light source.

Another embodiment of the invention relates to a flashlight including a housing that extends along a longitudinal housing axis from a first end to a second end, a light source provided at the first end of the housing, a rechargeable power supply electrically coupled to the light source to power the light source, a generator electrically coupled to the rechargeable power supply to charge the rechargeable power supply, and a hand crank coupled to the generator to turn the generator, the hand crank including a base and an arm, the hand crank movable between a storage position and a cranking position. The base is rotatably coupled to the second end of the housing for rotation about the housing axis. The arm is translatable relative to the housing between a retracted position and an extended position such that when the arm is in the extended position, the arm is pivotable relative to the base between a translation position in which the arm is substantially parallel to the housing axis and a fixed position in which the arm is substantially perpendicular to the housing axis so that when the hand crank is in the storage position, the arm is in the refracted and translation positions and when the hand crank is in the cranking position, the arm is in the extended and fixed positions.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

The skilled artisan will understand that the drawings primarily are for illustrative purposes and are not intended to limit the scope of the inventive subject matter described herein.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring to FIG. 1-4, a flashlight 10 is shown according to an exemplary embodiment. The flashlight 10 includes a hollow, elongated housing 12 (e.g., body, casing, etc.). The housing 12 is formed from a material such as a metal or metal alloy (e.g., steel, aluminum, etc.) or a polymer. A light source 13 (e.g., incandescent bulb, light-emitting diode (LED), halogen bulb, etc.) (FIG. 7) is provided on a first end 14 of the housing 12. A reflector and lens may be provided to direct and concentrate the light produced by the light source 13 in a direction away from the first end 14. The flashlight 10 may include other features, such as a clip with which the flashlight 10 may be coupled to another object, such as a belt.

Figures 1, 2:
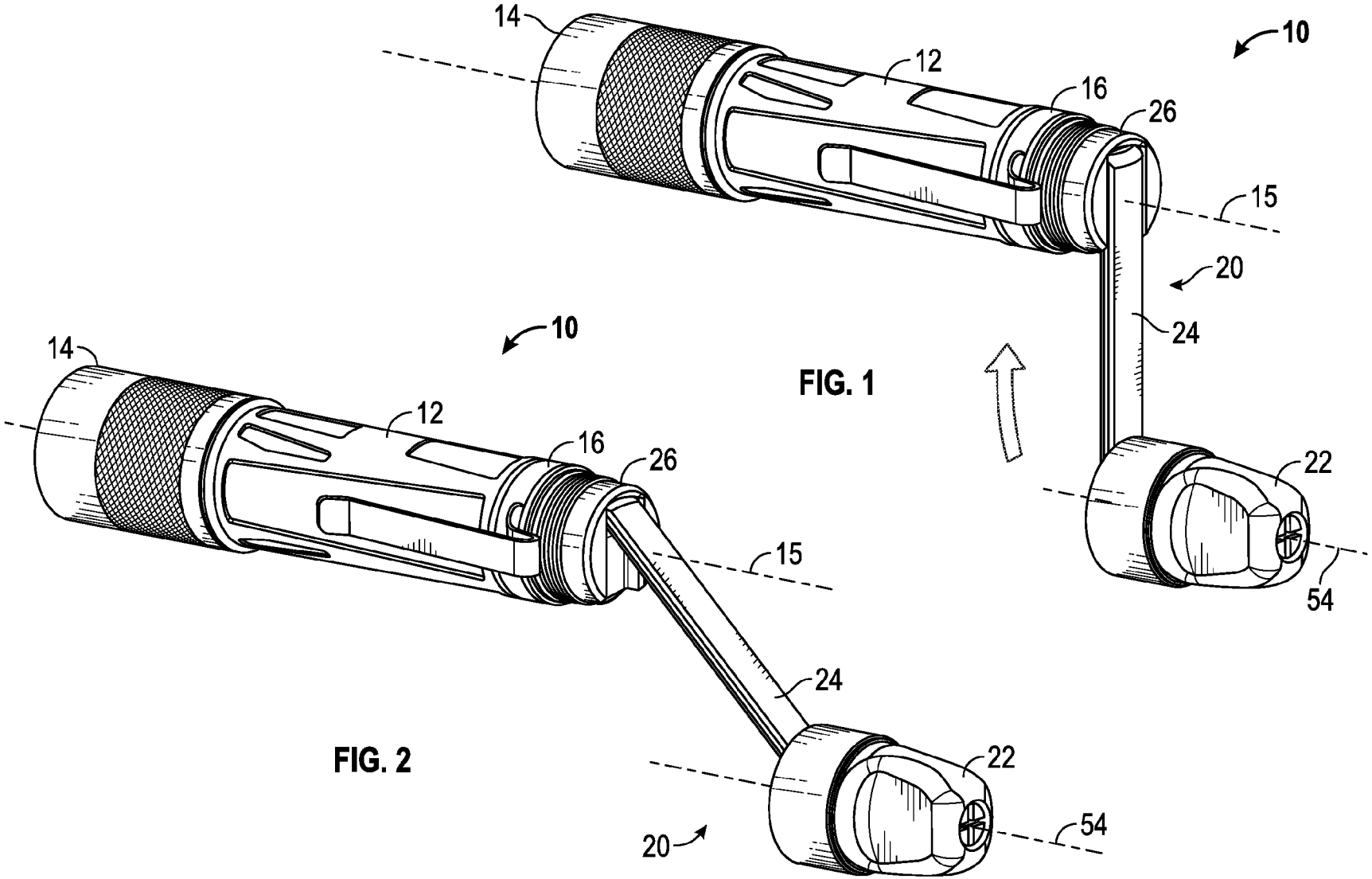
FIG. 1 is an isometric view of a flashlight with a crank folded into a cranking position, in accordance with an exemplary embodiment.
FIG. 2 is an isometric view of the flashlight of FIG. 1 with the crank extended, in accordance with an exemplary embodiment.
Figure 3:
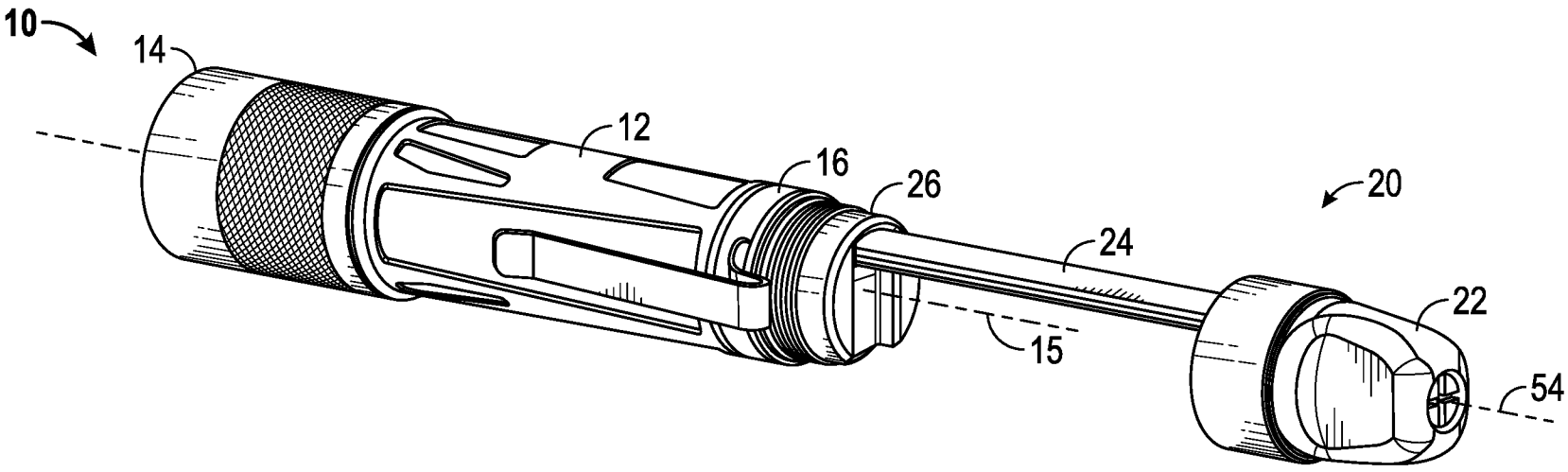
FIG. 3 is an isometric view of the flashlight of FIG. 1 with the crank partially extended, in accordance with an exemplary embodiment.
Figure 4:
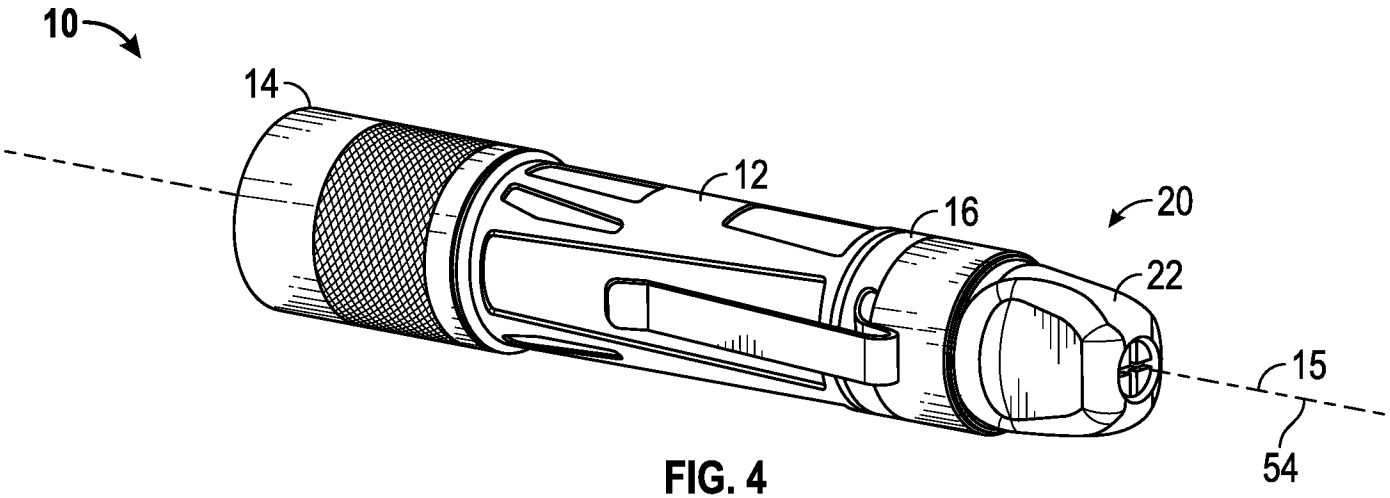
FIG. 4 is an isometric view of the flashlight of FIG. 1 with the crank in a storage position, in accordance with an exemplary embodiment.
Figure 5:
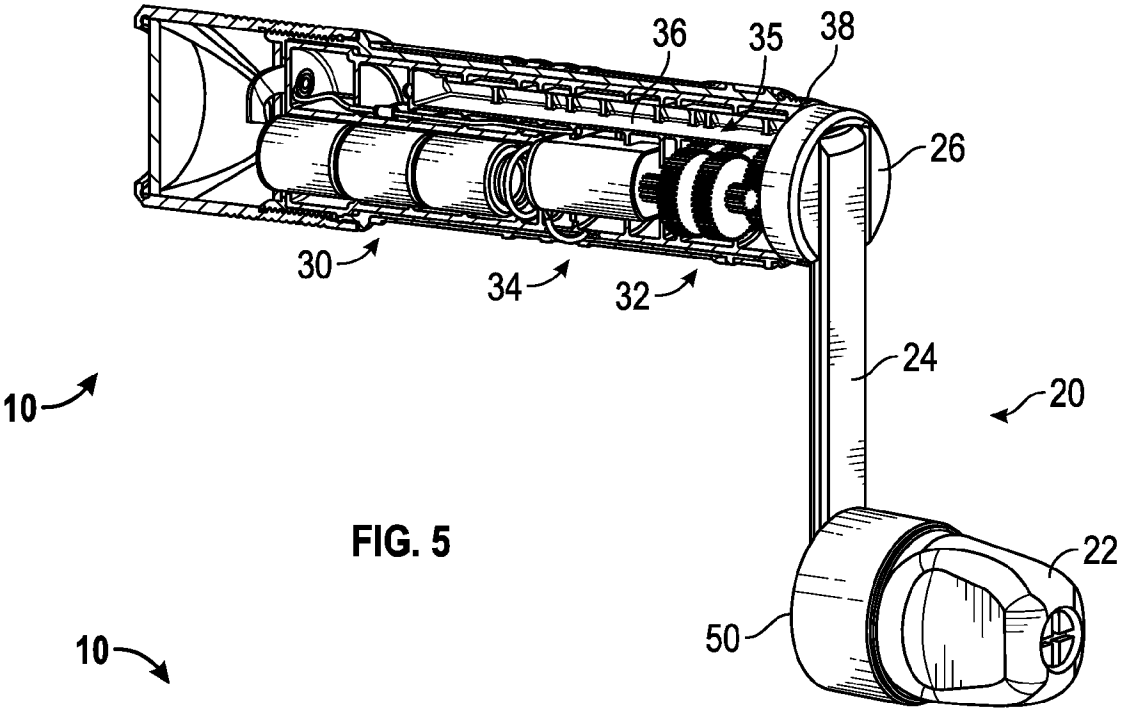
FIG. 5 is a rear isometric partial cross-section view of the flashlight of FIG. 1 with the crank folded into the cranking position, in accordance with an exemplary embodiment.
Figure 6:
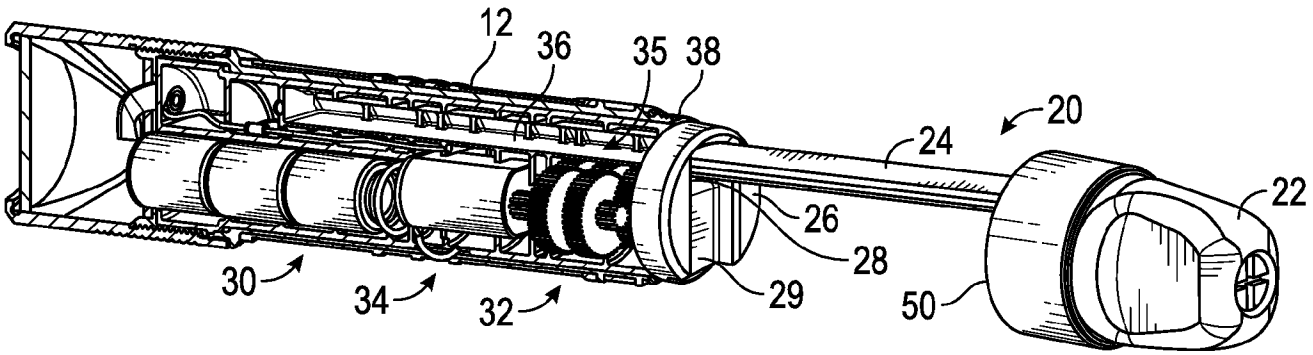
FIG. 6 is a rear isometric partial cross-section view of the flashlight of FIG. 1 with the crank extended, in accordance with an exemplary embodiment.
Figure 7:
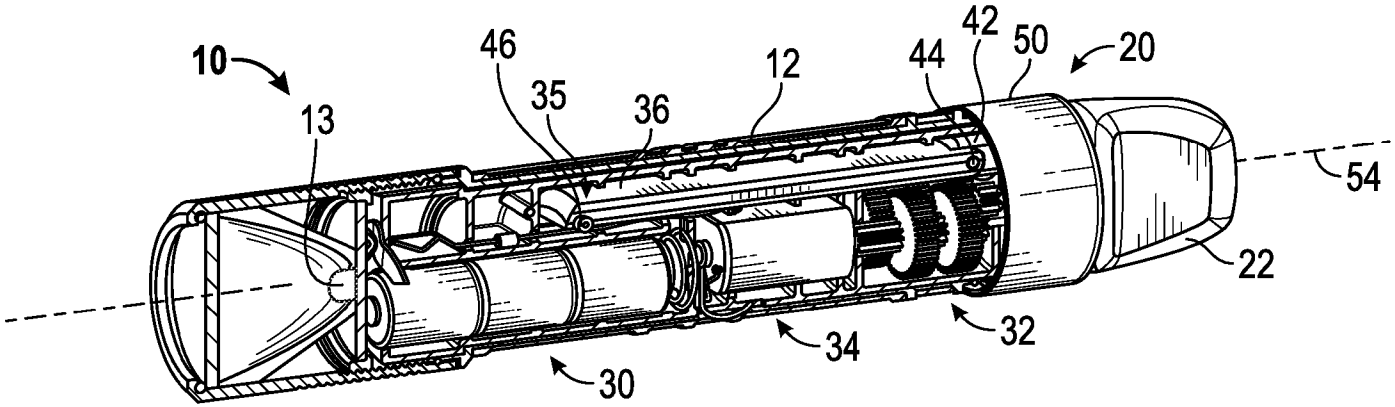
FIG. 7 is a front isometric partial cross-section view of the flashlight of FIG. 1 with the crank in the storage position, in accordance with an exemplary embodiment.
Figure 8:
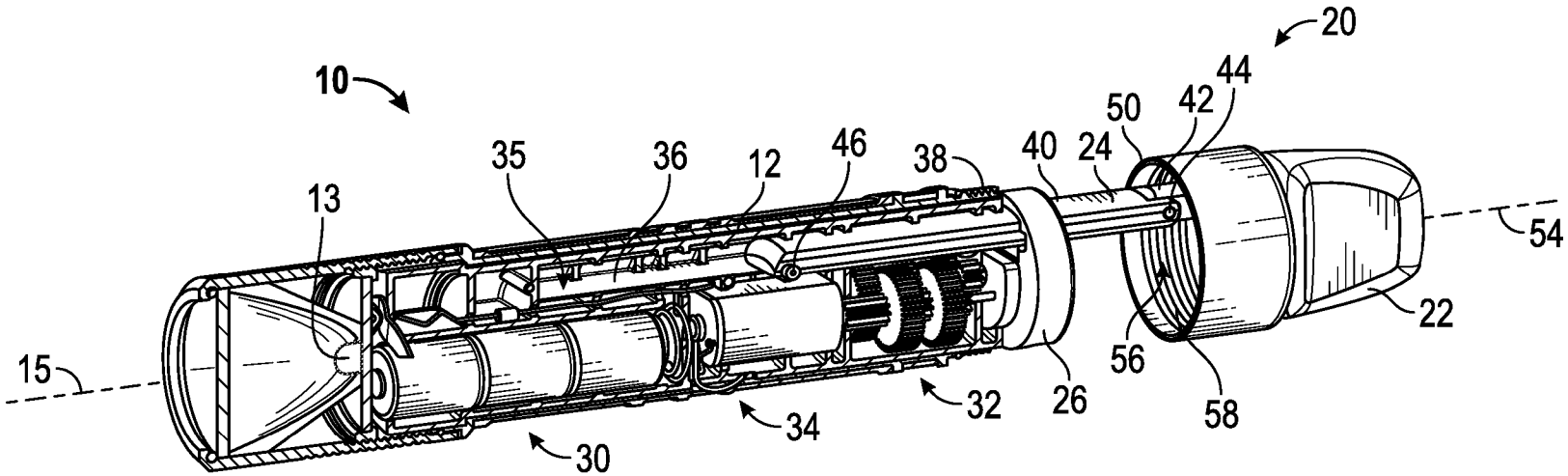
FIG. 8 is a front isometric partial cross-section view of the flashlight of FIG. 1 with the crank partially extended, in accordance with an exemplary embodiment.
Figure 9:
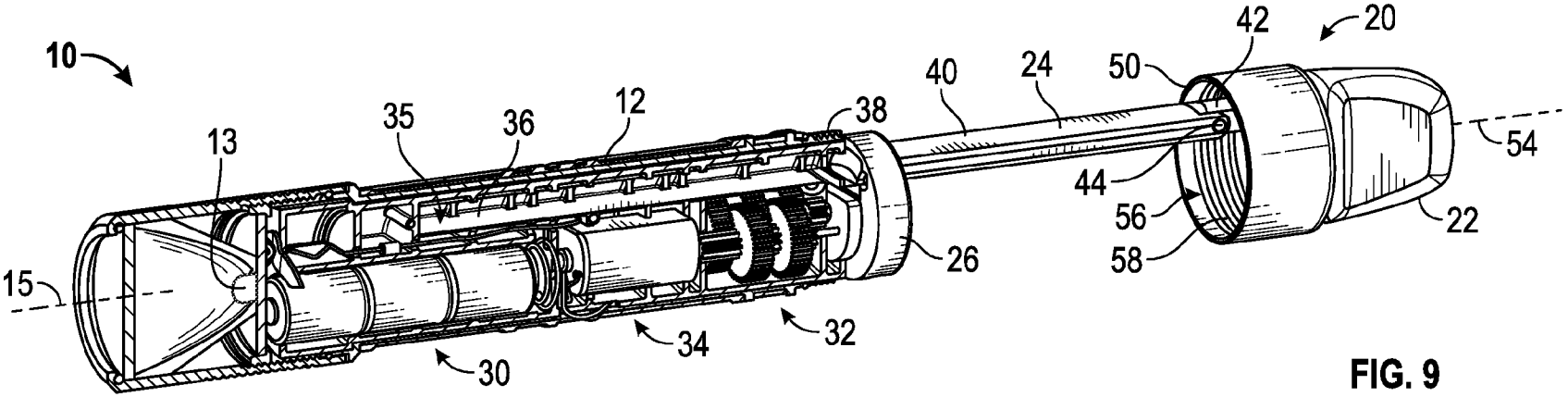
FIG. 9 is a front isometric partial cross-section view of the flashlight of FIG. 1 with the crank extended, in accordance with an exemplary embodiment.
Figure 10:
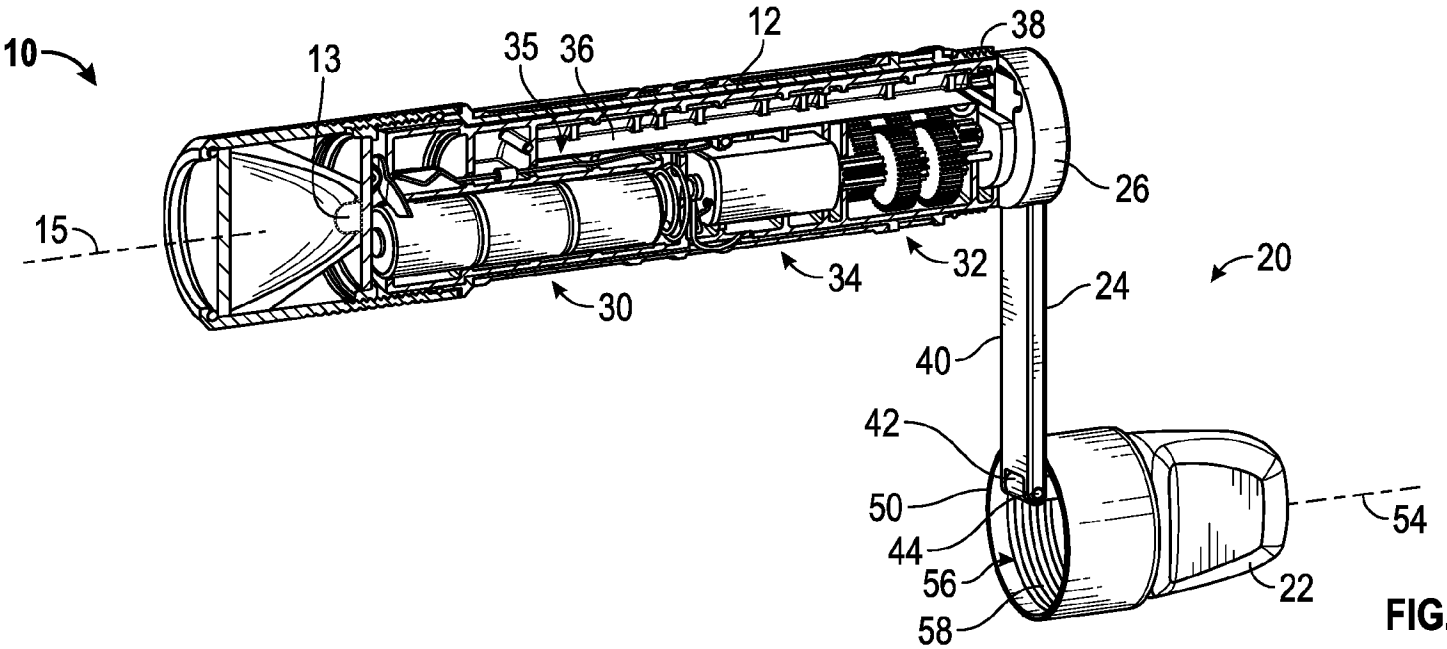
FIG. 10 is a front isometric partial cross-section view of the flashlight of FIG. 1 with the crank folded into the cranking position, in accordance with an exemplary embodiment.

A hand crank 20 extends from a second end 16 of the housing 12. The crank 20 includes a handle 22 coupled by an arm 24 to a base 26 forming the end cap of the housing 12. The base 26 is rotatably coupled to the second end 16 of the housing 12. The hand crank 20 is moveable between a first or storage position (FIG. 4) in which the arm 24 is refracted into the housing 12 (FIGS. 4 and 12) and a second or cranking position in which the arm 24 extends out of the housing 12 (FIGS. 3 and 7). In the second position (FIG. 1), the crank 20 may be turned (e.g., rotated, cranked, spun, twisted, etc.) about a longitudinal axis 15 of the housing 12 to charge the flashlight 10. The orientation of the crank 20 relative to the housing 12 allows the housing 12 to be conveniently grasped and held stationary by the user in one hand as the crank 20 is turned with the other hand.

Referring now to FIGS. 5-18, the interior of the flashlight 10 is shown according to an exemplary embodiment. The housing 12 is a hollow body containing a rechargeable power supply 30, shown as a number of electrochemical cells (e.g., nickel metal hydride (NiMH) cells, lithium ion (Li-ion) cells, nickel cadmium (NiCd) cells, etc.) configured to power the light source 13. In another exemplary embodiment, the rechargeable power supply may be another device capable of storing electric energy, such as a capacitor or an ultracapacitor. In still other exemplary embodiments, energy may be stored mechanically, such as with a spring or a flywheel.

By turning the crank 20 about the longitudinal axis 15, a user can recharge the rechargeable power supply 30. In an exemplary embodiment where the rechargeable power supply 30 stores electrical energy, the crank 20 turns a gear train 32 coupled to a generator 34, which converts rotational mechanical energy to electrical energy. In one embodiment, the generator 34 may be a dynamo that provides a DC voltage to the rechargeable power supply 30. In another embodiment, the generator 34 may be an alternator and a rectifier or another device that provides a voltage to the rechargeable power supply 30.

Figure 12:
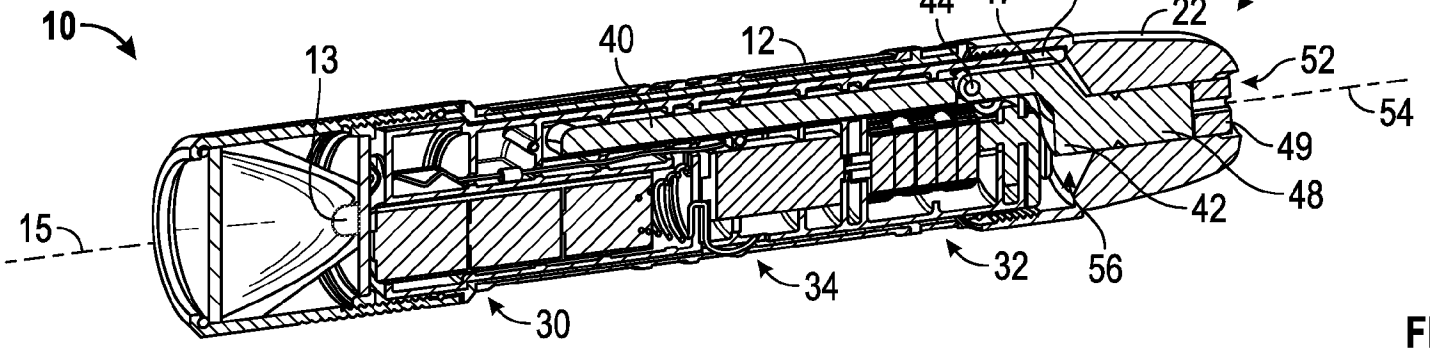
FIG. 12 is a front isometric cross-section view of the flashlight of FIG. 1 with the crank in the storage position, in accordance with an exemplary embodiment.
Figure 13:
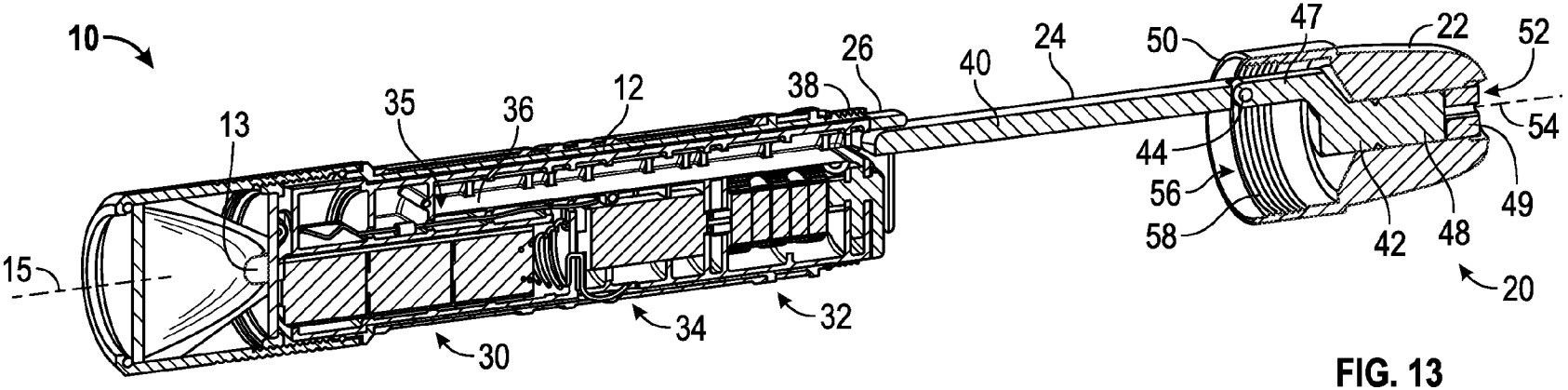
FIG. 13 is a front isometric cross-section view of the flashlight of FIG. 1 with the crank extended, in accordance with an exemplary embodiment.
Figure 14:
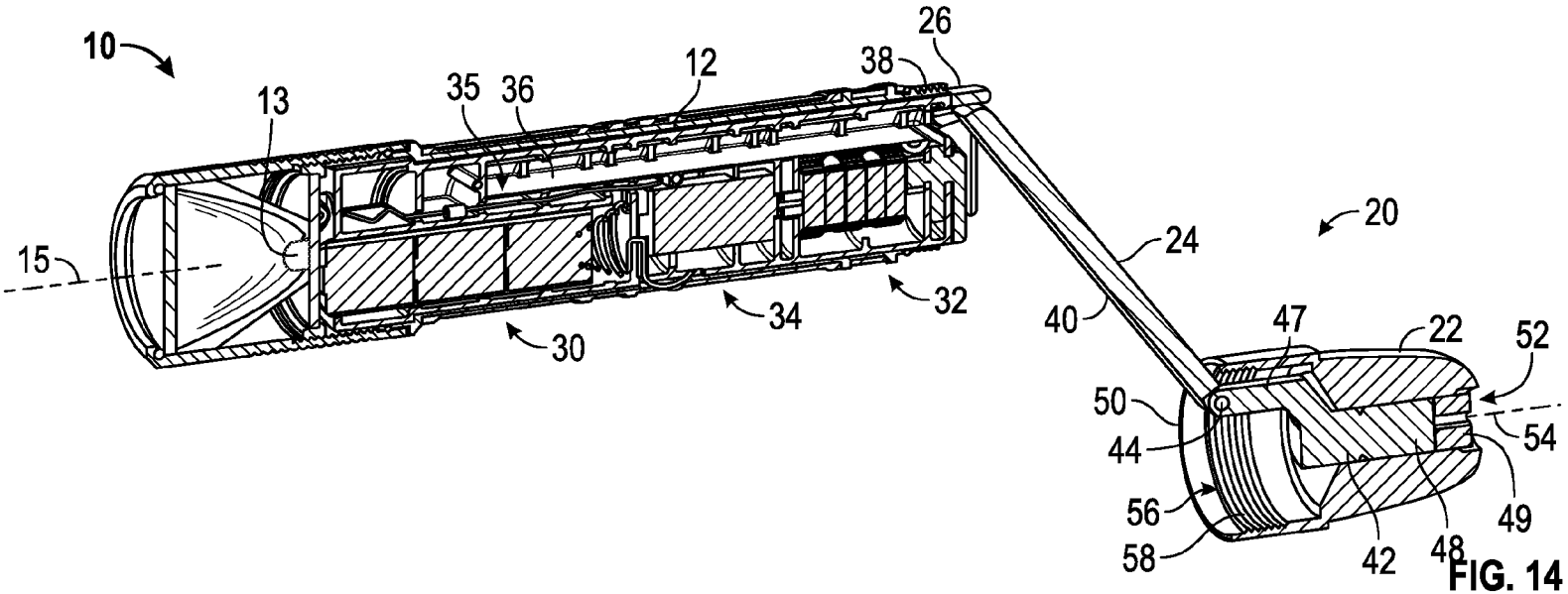
FIG. 14 is a front isometric cross-section view of the flashlight of FIG. 1 with the crank partially extended, in accordance with an exemplary embodiment.
Figure 15:
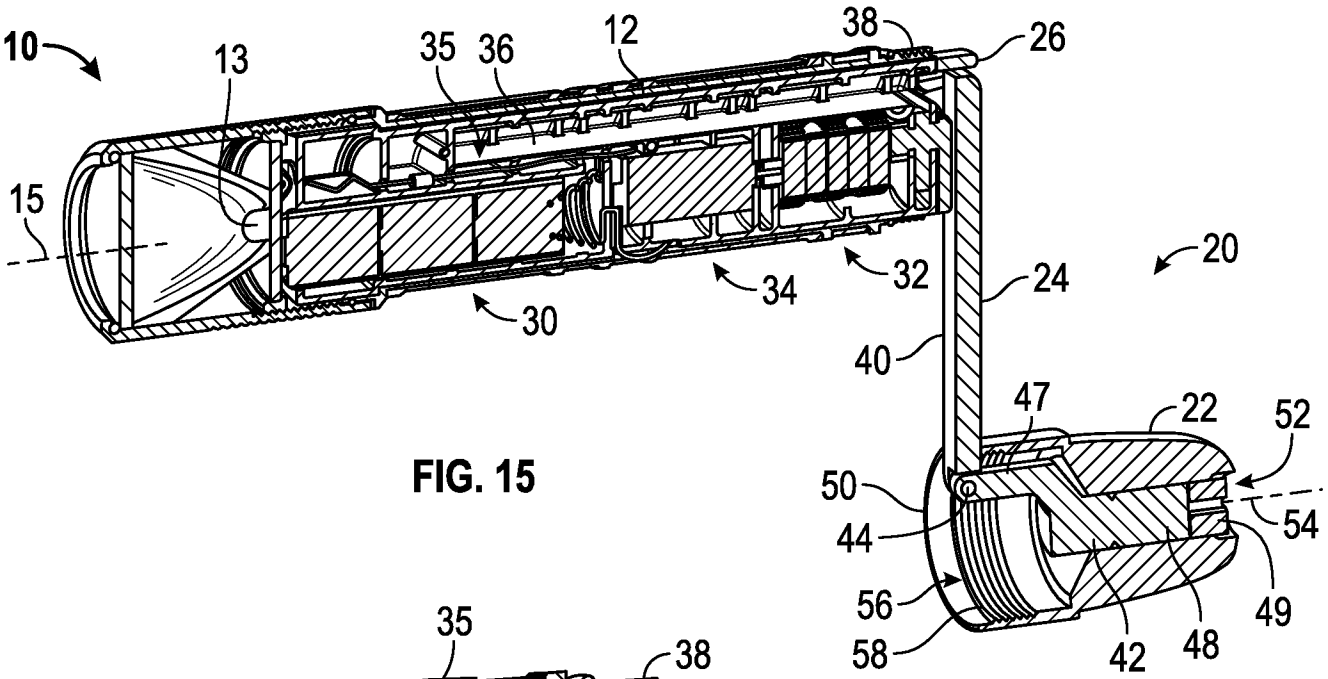
FIG. 15 is a front isometric cross-section view of the flashlight of FIG. 1 with the crank folded into the cranking position, in accordance with an exemplary embodiment.
Figure 16:
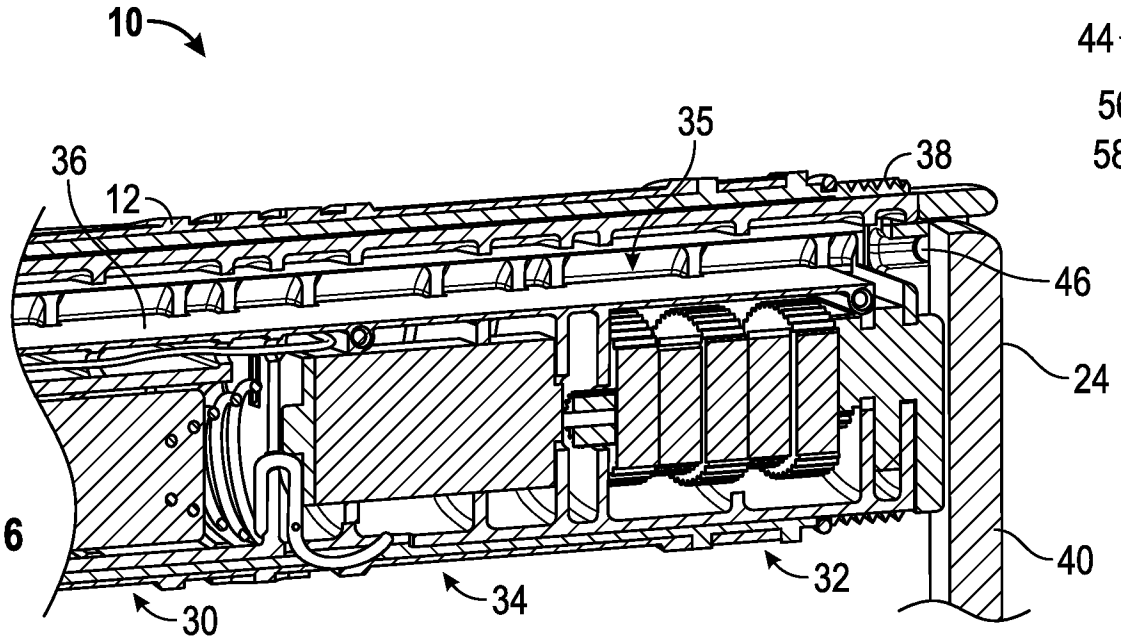
FIG. 16 is a detailed front isometric cross-section view of the rear portion of the flashlight of FIG. 1, in accordance with an exemplary embodiment.
Figure 17:
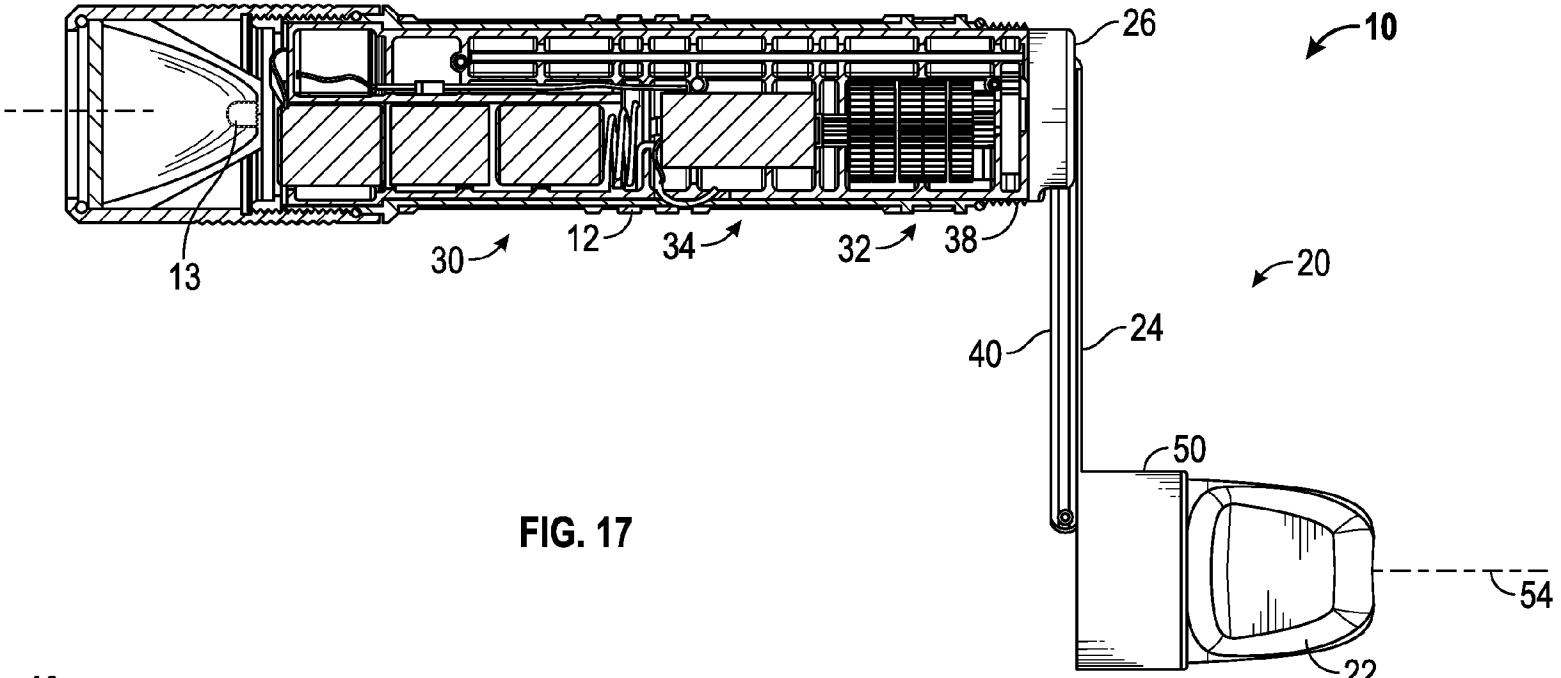
FIG. 17 is a cross-section view of the flashlight of FIG. 1 with the crank folded into the cranking position, in accordance with an exemplary embodiment.
Figure 18:
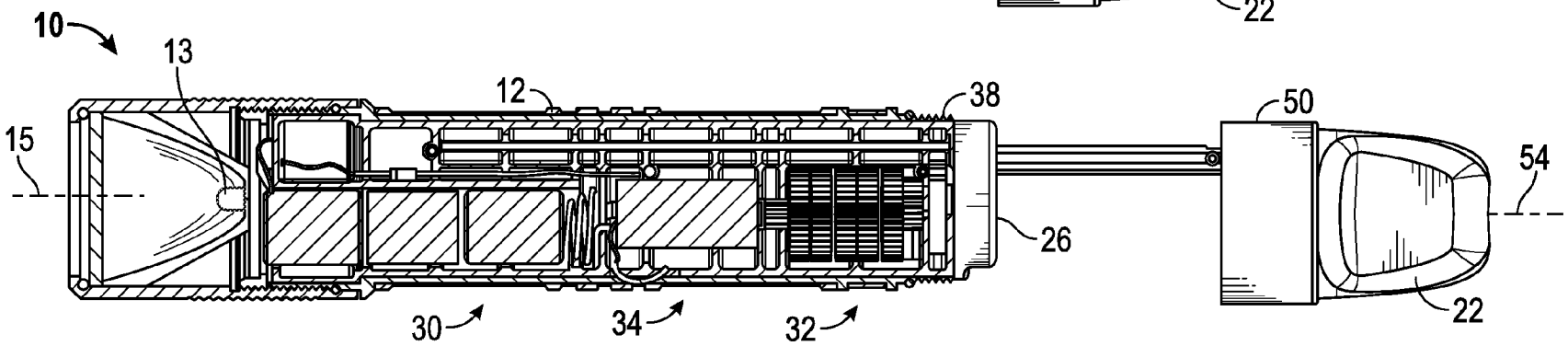
FIG. 18 is a cross-section view of the flashlight of FIG. 1 with the crank partially extended, in accordance with an exemplary embodiment.

As shown in FIGS. 7 and 12, when the crank 20 is in the first or storage position, the arm 24 is in a translation position and oriented parallel to the longitudinal axis 15 and is retracted into the interior of the housing 12 through an opening 28 (see FIG. 6) in the end cap 26 into a cavity 35 along an elongated rail 36. The cavity 35 is offset from the longitudinal axis 15 along a side of the interior of the housing 12. As shown in FIG. 12, the arm 24 includes a first link 40 and a second link 42 pivotably coupled to each other with a hinge 44. The end of the first link 40 opposite the hinge 44 includes bearing members, shown as rollers 46 that facilitate the sliding of the arm 24 into and out of the cavity 35 along the rail 36. The second link 42 includes a first portion 47 that is coupled to the first link 40 at the hinge 44. When the arm 24 is retracted into the cavity 35 in the housing 12, the first portion 47 is collinear with the first link 40. If the first link 40 is shorter than the depth of the cavity 35, the hinge 44 and at least a portion of the first portion 47 may be retracted into the cavity 35.

The second link 42 further includes a second portion 48 that is offset from the first portion 47. The second link 42 extends into an open end 50 of the handle 22 such that the second portion 48 is received in a bore 52 along the central axis 54 of the handle 22 (see FIGS. 12-15). The second link 42 is retained in the bore by a cap 49. The second portion 48 can rotate relative to the handle 42 in the bore 52 about the axis 54. The walls of the bore 52 provide a bearing surface for the second portion 48. In one embodiment, the second portion 48 and the bore 52 may each be cylindrical with a circular cross-section. In another embodiment, the bore 52 may be cylindrical and the second portion 48 may have a differently shaped cross-section (e.g., oval, square, hexagonal, octagonal, triangular, etc.). In still other exemplary embodiments, the bore 52 may not be cylindrical or may not provide a solid bearing surface for the second portion 48 (e.g., the bore 52 may be formed by a multitude of radially arranged longitudinal walls or fins).

The open end 50 of the handle 42 forms a hollow cavity 56 with an interior diameter that is greater than the diameter of the base 26. When the crank 20 is in the storage position, base 26 is received in the hollow cavity 56 and the central axis 54 of the handle 22 is collinear with the longitudinal axis 15 of the housing 12. Internal threads 58 are provided on the walls defining the hollow cavity 56 and corresponding threads 38 are provided on the exterior of the second end 16 of the housing 12. Because the handle 22 is able to rotate relative to the arm 24, the handle 22 may also be rotated relative to the housing 12 about the axes 15 and 54 to couple the handle 22 to the housing 12 with the threads 38 and 58.

In the storage position, the crank 20 is unobtrusive, with the arm 24 being retracted into the housing 12 or in the interior of the cavity 35 and the handle 22 forming a relatively continuous outer surface with the housing 12.

Figure 11:
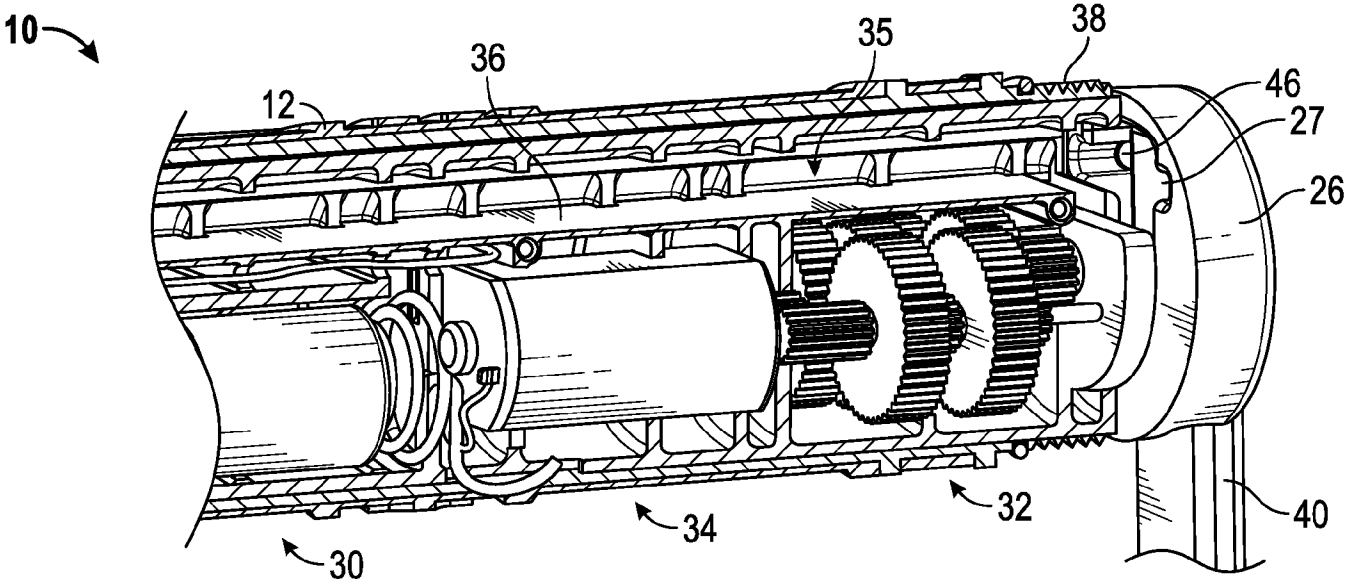
FIG. 11 is a detailed front isometric partial cross-section view of the rear portion of the flashlight of FIG. 1, in accordance with an exemplary embodiment.

As shown in FIGS. 1, 5, 10, 11, 15 and 17, when the crank 20 is in the second or cranking position, the arm 24 is pulled out of the interior of the housing 12 to the extended position and is a fixed position, oriented normal to or perpendicular to the longitudinal axis 15. As shown in FIG. 11, the arm 24 remains coupled to the base 26 by the rollers 46, which are wider than the opening 28. The rollers 46 are received in a socket 27 on the interior surface of the base 26 to form a pivot point about which the first link 40 may be rotated from an orientation parallel to the longitudinal axis 15 (i.e., in the translation position) to an orientation normal to the longitudinal axis 15 (i.e., in the fixed position). In the cranking position, the first link 40 is received in a slot 29 (e.g., hollow, recess, depression, etc.) on the outer surface of the base 26. With the first link 40 in the slot 29, the arm 24 is able to apply a torque to the base 26 so to rotate the base 26 about the longitudinal axis 15. As the handle 22 and the crank arm 24 are rotated about the longitudinal axis 15, the base 26 is therefore also rotated relative to the housing 12, which is held stationary. The base 26 may be coupled to the housing 12, for instance, with a low friction bearing, allowing the base 26 to rotate relative to the housing 12 about the axis. The rotation of the base 26 rotates the generator 34 via the gear train 32 to convert rotational mechanical energy to electrical energy.

The mechanical advantage provided by the crank 20 (e.g., the length of the arm 20 and the distance between the axes 54 and 15) and the gear ratio of the gear train are selected to allow the generator to be turned at a sufficient rate (e.g., a predetermined number of rotations of the generator for every rotation of the crank 20) with a resistance torque that can be overcome by a user. By mounting the arm 24 such that it is retracted into the housing 12, the length of the arm 24 and the mechanical advantage provided by the crank 20 may be maximized. Further, the configuration of the flashlight 10, with the crank 20 mounted to an end 16 and rotating about the longitudinal axis 15, allows any portion of the entire housing 12 to be grasped by the user without interfering with the rotation of the crank 20.

While the arm 24 is shown in the figures and described above as being normal to the longitudinal axis 15 of the housing 12 in the cranking position, in other embodiments, the arm 24 may not fold into a position normal to the axis 15. Folding the arm 24 normal to the axis 15 maximizes the mechanical advantage provided by the arm 24 in the turning of the base 26 (and, in turn, the gear train 32 and the generator 34) via the handle 22. However, in other embodiments, the arm 24 may be configured to be folded to some angle less than 90 degrees.

Figure 19:
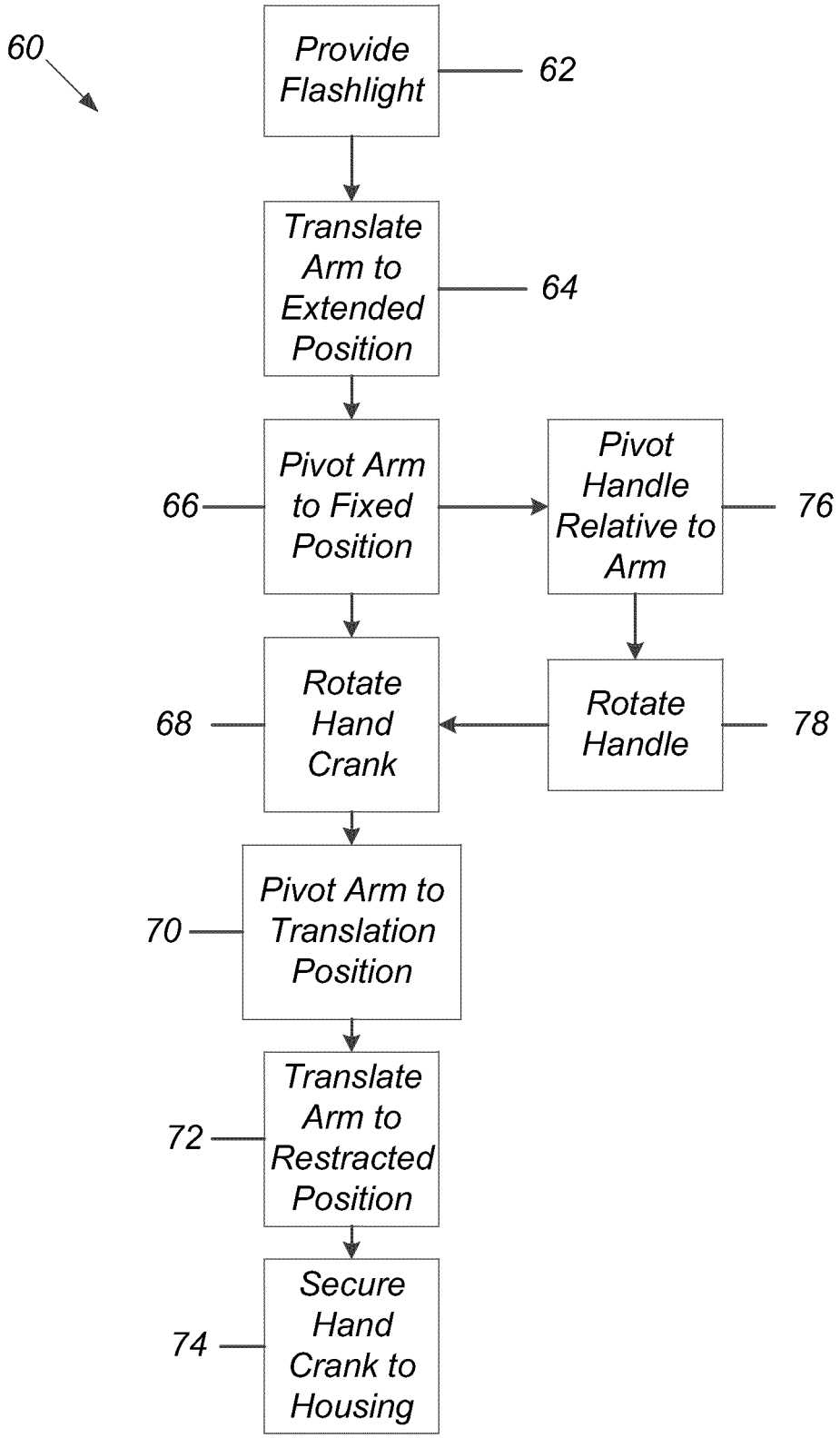
FIG. 19 is a flow chart illustrating a method of operating the flashlight of FIG. 1.

Referring to FIG. 19, a method 60 of operating the flashlight 10 according to an exemplary embodiment is illustrated. After providing a flashlight 10 (step 62), the arm 24 is translated out of the housing 12 in a direction substantially parallel to the longitudinal axis 15 of the housing to the extended position (step 64). Then, the arm 24 is pivoted relative to the base 26 to the fixed position in which the arm 24 is substantially perpendicular to the longitudinal axis 15 (step 66). Next, the hand crank 20 is rotated about the longitudinal axis 15 to turn the generator 34, thereby charging the rechargeable power supply 30 and powering the light source 13 (step 68). After the user is finished charging the rechargeable power supply 30 and/or powering the light source 13, the arm 24 is pivoted relative to the base 26 to the translation position (step 70). Next, the arm 24 is translated into the housing 12 in the direction substantially parallel to the longitudinal axis 15 to the retracted position (step 72). The hand crank 20 is then secured to the housing 12 (e.g. by threads 38 and 58) with the arm 24 in the translation and retracted positions to prevent rotation of the base 26 relative to the longitudinal axis 15 (step 74). Alternatively, prior to step 68, the handle 22 is pivoted relative to the arm 24 (step 76) and the handle 22 is rotated about the axis 54 (step 78).

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the flashlight as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. Some like components have been described in the present disclosure using the same reference numerals in different figures. This should not be construed as an implication that these components are identical in all embodiments; various modifications may be made in various different embodiments. It should be noted that the elements and/or assemblies of the enclosure may be constructed from any of a wide variety of materials that provide sufficient strength or durability, in any of a wide variety of colors, textures, and combinations.

What is claimed is:

1. A flashlight, comprising:

a housing that extends along a longitudinal housing axis from a first end to a second end;

a light source provided at the first end of the housing;

a rechargeable power supply electrically coupled to the light source to power the light source;

a generator electrically coupled to the rechargeable power supply to charge the rechargeable power supply; and a hand crank coupled to the generator to turn the generator, the hand crank including a base, a handle, and an arm having a first end coupled to the base and a second end coupled to the handle, the hand crank movable between a storage position and a cranking position;

wherein the base is rotatably coupled to the second end of the housing for rotation about the housing axis;

wherein the arm is translatable relative to the housing between a retracted position and an extended position such that when the arm is in the extended position, the arm is pivotable relative to the base between a translation position in which the arm is substantially parallel to the housing axis and a fixed position in which the arm is substantially perpendicular to the housing axis so that when the hand crank is in the storage position, the arm is in the retracted and translation positions and when the hand crank is in the cranking position, the arm is in the extended and fixed positions;

wherein the handle is pivotable relative to the arm such that when the arm is in the fixed position, the handle is rotatable about a handle axis substantially parallel to the housing axis;

wherein the housing defines a housing cavity that receives the arm when the arm is in the retracted position;

wherein the housing further includes a rail positioned in the cavity, the rail substantially parallel to the housing axis; and wherein the arm further includes a first link pivotally coupled to a second link at a hinge, the first link includes the first end of the arm with the first end of the arm located opposite the hinge and a bearing positioned at the first end of the arm, the bearing configured to engage the rail and to stop the arm in the extended position, the second link includes the second end of the arm with the second end of the arm located opposite the hinge.

2. The flashlight of claim 1, wherein the handle includes a handle end that defines a handle cavity having a diameter greater than an outer diameter of the base such that when the arm is in the retracted position, the base is positioned in the handle cavity.

3. The flashlight of claim 2, wherein the handle end includes internal threads and the second end of the housing includes corresponding external threads for securing the hand crank in the storage position.

4. The flashlight of claim 1, wherein the base further includes a socket that receives the bearing when the arm is in the extended position.

5. The flashlight of claim 1, wherein the base defines a slot for receiving the first link of the arm when the arm is in the fixed position.

6. The flashlight of claim 1, wherein when the arm is in the retracted position, the hinge is positioned in the housing cavity.

7. The flashlight of claim 6, wherein the base defines a slot for receiving the first link of the arm when the arm is in the fixed position.

8. The flashlight of claim 7, wherein the handle includes a handle end that defines a handle cavity having a diameter greater than an outer diameter of the base such that when the arm is in the retracted position, the base is positioned in the handle cavity.

9. The flashlight of claim 8, wherein the handle end includes internal threads and the second end of the housing includes corresponding external threads for securing the hand crank in the storage position.

10. The flashlight of claim 9, wherein the base further includes a socket that receives the bearing when the arm is in the extended position.

11. A rechargeable apparatus configured to be charged in response to a manual input, the rechargeable apparatus comprising:

a housing that extends along a longitudinal housing axis from a first end to a second end;

a rechargeable power supply;

a generator electrically coupled to the rechargeable power supply to charge the rechargeable power supply; and a hand crank coupled to the generator to turn the generator, the hand crank including a base, a handle, and an arm having a first end coupled to the base and a second end coupled to the handle, the hand crank movable between a storage position and a cranking position;

wherein the base is rotatably coupled to the second end of the housing for rotation about the housing axis;

wherein the arm is translatable relative to the housing between a retracted position and an extended position such that when the arm is in the extended position, the arm is pivotable relative to the base between a translation position in which the arm is substantially parallel to the housing axis and a fixed position in which the arm is substantially perpendicular to the housing axis so that when the hand crank is in the storage position, the arm is in the retracted and translation positions and when the hand crank is in the cranking position, the arm is in the extended and fixed positions;

wherein the handle is pivotable relative to the arm such that when the arm is in the fixed position, the handle is rotatable about a handle axis substantially parallel to the housing axis;

wherein the housing defines a housing cavity that receives the arm when the arm is in the retracted position;

wherein the housing further includes a rail positioned in the cavity, the rail substantially parallel to the housing axis; and wherein the arm further includes a first link pivotally coupled to a second link at a hinge, the first link includes the first end of the arm with the first end of the arm located opposite the hinge and a bearing positioned at the first end of the arm, the bearing configured to engage the rail and to stop the arm in the extended position, the second link includes the second end of the arm with the second end of the arm located opposite the hinge.

12. The rechargeable apparatus of claim 11, wherein the handle includes a handle end that defines a handle cavity having a diameter greater than an outer diameter of the base such that when the arm is in the retracted position, the base is positioned in the handle cavity.

13. The rechargeable apparatus of claim 12, wherein the handle end includes internal threads and the second end of the housing includes corresponding external threads for securing the hand crank in the storage position.

14. The rechargeable apparatus of claim 11, wherein the base further includes a socket that receives the bearing when the arm is in the extended position.

15. The rechargeable apparatus of claim 11, wherein the base defines a slot for receiving the first link of the arm when the arm is in the fixed position.

16. The rechargeable apparatus of claim 11, wherein when the arm is in the retracted position, the hinge is positioned in the housing cavity.

17. The rechargeable apparatus of claim 16, wherein the base defines a slot for receiving the first link of the arm when the arm is in the fixed position.

18. The rechargeable apparatus of claim 17, wherein the handle includes a handle end that defines a handle cavity having a diameter greater than an outer diameter of the base such that when the arm is in the retracted position, the base is positioned in the handle cavity.

19. The rechargeable apparatus of claim 18, wherein the handle end includes internal threads and the second end of the housing includes corresponding external threads for securing the hand crank in the storage position.

20. The rechargeable apparatus of claim 19, wherein the base further includes a socket that receives the bearing when the arm is in the extended position.

* * * * *